US008997630B2

(12) United States Patent
Heurich et al.

(10) Patent No.: US 8,997,630 B2
(45) Date of Patent: Apr. 7, 2015

(54) PISTON-CYLINDER ASSEMBLY HAVING INTEGRATED MEASURING DEVICE

(75) Inventors: Mike Heurich, Apelern (DE); Tino Wiggers, Seelze (DE)

(73) Assignee: WABCO GmbH, Hannover (DE)

( * ) Notice: Subject to any disclaimer, the term of this patent is extended or adjusted under 35 U.S.C. 154(b) by 867 days.

(21) Appl. No.: 13/145,134

(22) PCT Filed: Sep. 17, 2009

(86) PCT No.: PCT/EP2009/006708

§ 371 (c)(1),
(2), (4) Date: Aug. 30, 2011

(87) PCT Pub. No.: WO2010/088931

PCT Pub. Date: Aug. 12, 2010

(65) Prior Publication Data

US 2011/0303085 A1 Dec. 15, 2011

(30) Foreign Application Priority Data

Feb. 5, 2009 (DE) ..... 10 2009 007 657

(51) Int. Cl.
*F15B 15/28* (2006.01)

(52) U.S. Cl.
CPC ..... *F15B 15/2861* (2013.01); *F15B 15/28* (2013.01)

(58) Field of Classification Search
CPC ..... F15B 15/28; F15B 15/2861
USPC ..... 92/5 R; 91/1
See application file for complete search history.

(56) References Cited

U.S. PATENT DOCUMENTS

| | | | | |
|---|---|---|---|---|
| 3,654,549 | A * | 4/1972 | Maurer et al. | 324/207.16 |
| 5,852,936 | A * | 12/1998 | Bellak | 92/5 R |
| 6,293,530 | B1 * | 9/2001 | Delorenzis et al. | 267/64.13 |
| 6,450,048 | B1 * | 9/2002 | Samuelson et al. | 73/866.5 |
| 6,478,310 | B1 * | 11/2002 | Azami | 92/5 R |
| 6,974,138 | B2 * | 12/2005 | Perello et al. | 280/5.522 |
| 7,059,238 | B2 * | 6/2006 | Albright et al. | 92/5 R |
| 2004/0140642 | A1 | 7/2004 | Perello et al. | |
| 2009/0065323 | A1 * | 3/2009 | Busold | 192/85 CA |

FOREIGN PATENT DOCUMENTS

DE 10 2006 021 130 B3 8/2007

* cited by examiner

*Primary Examiner* — Thomas E Lazo
(74) *Attorney, Agent, or Firm* — Kramer Levin Naftalis & Frankel LLP

(57) ABSTRACT

A piston-cylinder assembly, in particular for pneumatic, hydraulic or mechatronic systems, includes a cylinder housing and a piston. The piston is coupled to a piston rod and disposed in the cylinder housing such that it can move along a longitudinal axis. A measuring device for detecting piston or piston rod position is provided inside the cylinder housing.

11 Claims, 2 Drawing Sheets

PISTON-CYLINDER ASSEMBLY HAVING INTEGRATED MEASURING DEVICE

FIELD OF THE INVENTION

The present invention generally relates to a piston-cylinder assembly, in particular for pneumatic, hydraulic or mechatronic systems, having a cylinder housing and a piston, which is coupled to a piston rod, and which is arranged in the cylinder housing such that it can be moved along a longitudinal axis.

BACKGROUND OF THE INVENTION

Piston-cylinder assemblies of the general type under consideration are used predominantly in pneumatic gearshifts, mechatronic units, pneumatic systems and hydraulic systems. The piston-cylinder assembly usually serves the purpose of converting pressures that are applied to a piston into a movement of the piston rod. This movement is used in the different technical fields for controlling and/or for driving machines or machine elements.

In order to make it possible to monitor and/or control the movement of such machines, it is of increased importance to be able to determine the piston stroke that actually takes place and results from the applied pressure. A detection of the position of the piston and/or the piston rod is therefore required.

Conventionally, position detection of the piston or the piston rod is accomplished by means of measuring devices arranged externally on the piston-cylinder assembly that detect the position change of the piston rod by means of various measuring methods, for example inductive measuring methods. This presents several disadvantages. In particular, in installation surroundings that require a small installation space of the piston-cylinder assembly, the known measuring systems cannot be used. The installation space that is often available is not dimensioned sufficiently for this purpose. In particular, the installation dimension of the piston-cylinder assembly in the stroke direction is typically restricted in practice. However, this is exactly the preferred arrangement of the measuring systems in constructions of the type noted above.

SUMMARY OF THE INVENTION

Generally speaking, it is an object of the present invention to specify a piston-cylinder assembly that makes position detection of the piston and/or the piston rod possible with as small an installation space as possible. In an apparatus of the general type under consideration, in accordance with embodiments of the present invention, the foregoing object is achieved by way of a measuring device arranged within the cylinder housing.

Integrating the measuring device into the cylinder housing leads firstly to a considerable reduction in the installation space and secondly to a closer position of the measuring device to the piston and/or the piston rod. As a result of the reduced distance of the measuring device from the piston and/or from the piston rod, position detection becomes more accurate and less susceptible to disturbances, since potential disturbance variables that could act from the outside on the measuring device are firstly shielded by the cylinder housing and secondly can only still act on a reduced path between the measuring device and the measured object.

In one preferred embodiment of the present invention, the measuring device extends parallel to the longitudinal axis of the piston, and the piston and/or the piston rod can be moved axially relative to the measuring device. The parallel arrangement of the measuring device in relation to the piston achieves, in particular, shortening of the installation space in the stroke direction. Whereas the overall length has been influenced negatively in conventional systems as a result of arranging the measuring devices externally and, in particular, in front of or behind the cylinder housing in the stroke direction, as small an installation space as possible can be realized according to this inventive embodiment.

In a further embodiment of the present invention, the measuring apparatus has a PLCD sensor. By virtue of the inventive measuring device being integrated into the housing and positioned as closely as possible to the piston-cylinder assembly, it is possible to use PLCD sensors. This was not possible in conventional systems, since the spacing of a measuring device attached to the cylinder assembly from the outside from the movable piston and/or the piston rod was too great. This problem is made clear, in particular, when the functional principle of PLCD sensors is considered:

PLCD sensors typically have a core made from magnetically soft metal surrounded by a coil. The movable object, the position of which is to be determined, has a permanent magnet that generates a local magnetic saturation when it approaches the sensor. At the point of the smallest spacing between the magnetically soft core and the permanent magnet, this leads to a virtual division of the core in relation to its magnetic field. The application of an alternating current to the coil that surrounds the core leads to an induction of different voltages in secondary coils, which are arranged in each case at one end of the magnetically soft core. The magnitude of the different voltages that are induced in each case in the coils gives exact information about the strength of the magnetic field in the respective section of the core. In this way, conclusions can be made about the length of the respective part section, which in turn gives exact information about the position of the permanent magnet that has approached the sensor. If the permanent magnet is connected fixedly to the movable object, this therefore results in the respective position of the movable object. For reliable functioning of a sensor system of this type, the spacing between the signal-transmitting magnet and the sensor should be as small as possible.

According to another embodiment of the present invention, the PLCD sensor is arranged at least partially within a recess in the piston, and the measuring device has a magnet connected as signal transmitter to the piston. Because a recess is provided in the piston, the PLCD sensor can be arranged even further in the direction of the stroke axis. A minimum spacing between the sensor and the magnet attached to the piston can therefore be realized. The susceptibility to disturbances of the measuring device is reduced even further in this way.

According to a further, particularly preferred embodiment of the present invention, the magnet is configured as a ring magnet and is arranged coaxially with respect to the longitudinal axis of the piston. Thus, for example, the magnet can be arranged and fastened on a shoulder of cylindrical configuration. Jamming is unlikely as a result. As a result of the magnet being configured as a ring magnet, it is irrelevant for the correct function of the PLCD sensor and therefore of the measuring device whether, in addition to the pure stroke movement, the piston and/or the piston rod also perform/performs a rotation about the longitudinal axis of the piston and the piston rod. A rotation of the ring magnet has no influence on its magnetic field. Therefore, regardless of the rotary position of the piston and/or the piston rod, there is always the same magnetic field that acts on the sensor.

According to yet another embodiment of the present invention, the PLCD sensor is integrated into a cylinder cover. In this way, the sensor, which is positioned fixedly relative to the cylinder cover, can be introduced into the housing of the piston-cylinder assembly with high accuracy and reproducibility. This is facilitated, in particular, by the fact that the cylinder cover is always mounted in the same arrangement on the housing. Dismantling of the sensor is possible by simple removal of the cover and facilitates the maintenance and calibration of the measuring device.

According to a further embodiment of a piston-cylinder assembly according to the present invention, the PLCD sensor is placed within a sleeve that is integrally formed on the cylinder cover. The sleeve can advantageously be produced with low tolerances and can be adapted to the sensor. Furthermore, exact positioning of the sleeve is possible if the latter is positioned relative to the cylinder cover by way of locating elements that are known to persons skilled in the art. In an approach of this type, the cylinder cover can be, for example, a simple cast part.

According to a further advantageous embodiment of the present invention, the PLCD sensor is integrated into the piston, and the ring magnet is integrated into the cylinder housing or into a seal. In this configuration, the measurement of the piston position does not take place as a result of a movement of a magnet connected fixedly to the piston relative to a sensor attached in a stationary manner, but rather as a result of a movement of the sensor relative to a ring magnet attached in a stationary manner. A design of this type can be advantageous for reasons of production economy or on account of special requirements from the user.

In a further advantageous embodiment of the piston-cylinder assembly according to the invention, a trailer piston is arranged substantially coaxially with respect to the longitudinal axis of the piston and can be moved axially relative to the piston and/or the piston rod. Piston-cylinder assemblies that, in addition to a main piston, additionally have a trailer piston cannot be operated with the previously known measuring devices. The reason being that the trailer piston that is additionally arranged within the cylinder housing increases the spacing between the externally arranged measuring system and the main piston and/or the piston rod. As a result, reliable measurement of the position of the main piston and/or the piston rod is no longer possible. According to the present invention, however, this disadvantage is overcome, with the result that piston-cylinder assemblies with a trailer piston can also be realized in a very small installation space, with simultaneous position detection by means of a measuring device.

According to yet another advantageous embodiment of the present invention, the sensor extends at least partially within a recess provided in the trailer piston. In this way, the sensor can extend both within the piston and within the trailer piston, as a result of which the shortness of the installation space in the stroke direction remains uninfluenced. Furthermore, this makes it possible to arrange the sensor within a recess of the trailer piston such that the movement of the trailer piston has no influence on the measuring operation itself.

In a further embodiment of the present invention, the sensor is arranged between the ring magnet and the trailer piston. Accordingly, the sensor is moved into the direct vicinity of the ring magnet, and a measurement of the position of the ring magnet and therefore of the piston and/or of the piston rod can take place without the trailer piston, which surrounds the ring magnet and the sensor and the section of the main piston in which the sensor extends.

According to yet a further embodiment, the piston and the piston rod are connected integrally to one another. As a result, movement play between the two elements is ruled out, and it becomes irrelevant whether the position of the piston rod or of the piston is determined.

Still other objects and advantages of the present invention will in part be obvious and will in part be apparent from the specification.

The present invention accordingly comprises the features of construction, combination of elements, and arrangement of parts all as exemplified in the constructions herein set forth, and the scope of the invention will be indicated in the claims.

BRIEF DESCRIPTION OF THE DRAWINGS

The invention will be described in greater detail hereinafter using exemplary embodiments with reference to the appended drawing figures, in which.

DETAILED DESCRIPTION OF THE PREFERRED EMBODIMENTS

Figure 1:
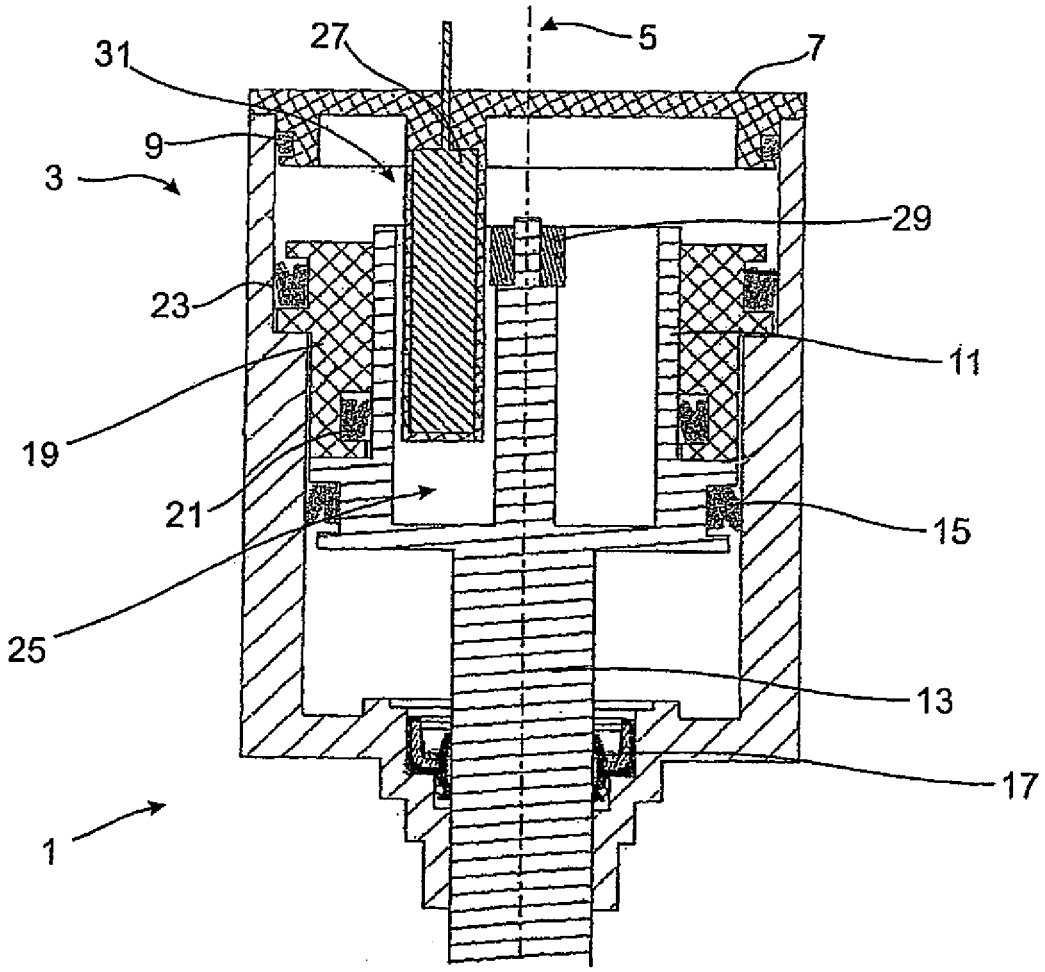
FIG. 1 is a sectional illustration of a piston-cylinder assembly according to an embodiment of the invention in the plane in which the longitudinal axis of the piston rod extends.

A piston-cylinder assembly 1 in accordance with an embodiment of the present invention is shown in FIG. 1. The piston-cylinder assembly 1 has a cylinder housing 3 that is closed with a cylinder cover 7. The cylinder housing 3 and the cylinder cover 7 are of rotationally symmetrical configuration with regard to an axis of symmetry 5 and are oriented coaxially with respect to one another. The cylinder cover 7 is sealed against an inner wall of the cylinder housing 3 by means of a sealing element 9. Evaluation electronics (not shown) can be arranged within the cylinder cover 7.

A main piston 11 is arranged within the cylinder housing 3 coaxially with respect to the axis 5. The main piston 11 is connected integrally to a piston rod 13, which is likewise oriented coaxially with respect to the axis 5. The main piston 13 is sealed by means of a sealing element 15 against an inner wall of the housing 3. A further sealing element 17 is arranged on an exit section of the housing 3, at which exit section the piston rod 13 exits the housing 3.

A trailer piston 19 is arranged in an upper (in FIG. 1) section of the main piston 11. The trailer piston 19 is of substantially annular configuration and surrounds the main piston 11 in the upper section of the main piston 11. The trailer piston 19 is sealed by means of a sealing element 21 against the main piston 11 and by means of a sealing element 23 against an inner wall of the housing 3. The trailer piston 19 can be moved axially in the direction of the axis 5 relative to the housing 3 and the main piston 11. The external diameter of the trailer piston 19 in the upper section is larger than the external diameter of the main piston 11 in the lower section. The main piston 11 has a recess 25 of annular configuration, which is oriented coaxially with respect to the axis 5 and extends from an upper end side of the main piston 11 into the piston.

A PLCD sensor 27 is arranged within the recess 25. The PLCD sensor 27 is part of a measuring device. A further part of the measuring device is a ring magnet 29, which is arranged fixedly, for example by a press fit, on an upper shoulder of the main piston 11 and is arranged coaxially with respect to the axis 5. The PLCD sensor 27 is arranged and oriented within a sensor housing 31 parallel to the axis 5. The sensor housing 31 is integrally formed on the cylinder cover 7. Conductor tracks are guided out of the housing 3 through the cylinder cover 7, starting from the sensor 27. The sensor 27 is therefore connected in a stationary manner to the cylinder cover 7 and therefore, in the mounted state, also to the housing 3. A movement of the main piston 11 and/or the rod 13 results in a movement of the ring magnet 29 relative to the sensor 27.

Figure 2:
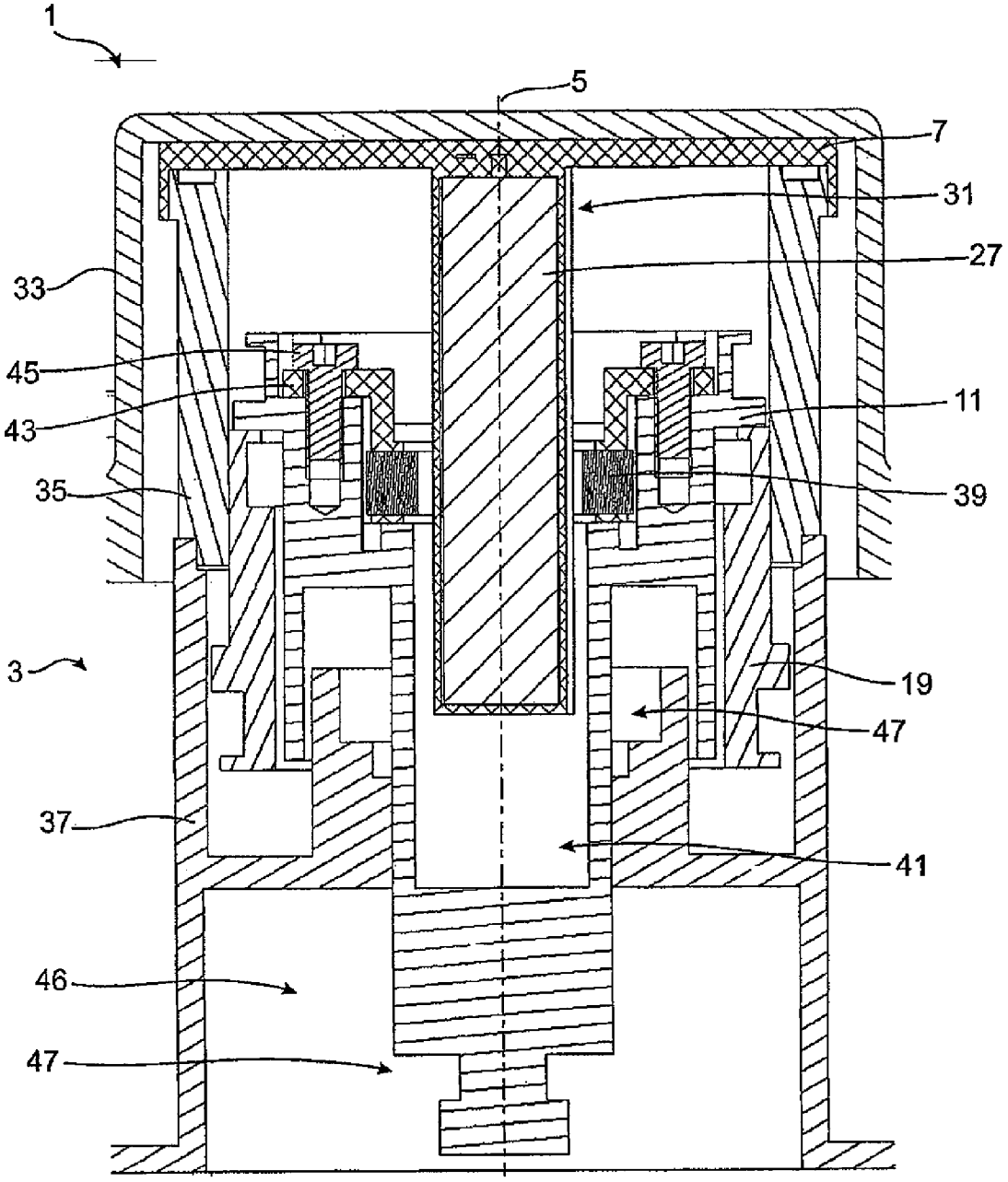
FIG. 2 is a sectional illustration of a further embodiment of the piston-cylinder assembly according to an embodiment of the invention in a plane in which the longitudinal axis of the piston rod extends.

FIG. 2 shows a further embodiment of a piston-cylinder assembly according to the invention. With regard to identical components, reference is made to the above descriptions and identical designations are used. In this embodiment, the housing 3 has two separately configured housing parts 35 and 37. The cylinder cover 7, to which the sensor housing 31 with the sensor 27 is integrally formed, is finally connected to the housing part 35. A bell 33 lies on the cylinder cover 7 and closes the housing 3. The external diameter of the main piston 11 is smaller in this embodiment than the external diameter of the trailer piston 19.

The main piston 11 is sealed by way of sealing elements (not shown) against the inner wall of the housing part 35, while the trailer piston 19 is sealed by way of sealing elements (likewise not shown) against the inner wall of the housing part 37. Furthermore, the main piston 11 is sealed by means of a sealing element (not shown) against a section 47 of the housing part 37. The main piston 11 has a cylindrical recess 41. The recess 41 is oriented coaxially with respect to the axis 5 and extends downwardly from the upper end face of the main piston 11. Furthermore, a carrier element 43 is arranged on the end side of the main piston 11 and is connected to the main piston by means of a fastener 45. The carrier element 43 is arranged rotationally symmetrically and coaxially with respect to the axis 5 and, furthermore, has a ring magnet 39, which is fastened to the main piston 11 by means of the carrier element 43.

According to the embodiment shown in FIG. 2, the PLCD sensor 27 is likewise oriented coaxially with respect to the axis 5 and is arranged within the cylinder housing 3 such that it dips through the trailer piston 19, the main piston 11 and the ring magnet 39. All the movable parts within the cylinder housing are therefore arranged rotationally symmetrically around the sensor 27 and coaxially with respect to the axis 5.

A recess 46 is provided in a lower section 46 of the housing part 37. Within this recess 46, the piston 11 extends out of the housing 3. At its lower end in FIG. 2, the main piston 11 has a connecting section 47, by means of which the main piston 11 can be connected to a piston rod (not shown).

It will be seen that the objects set forth above, among those made apparent from the preceding description, are efficiently attained, and since certain changes may be made without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention that, as a matter of language, might be said to fall therebetween.

What is claimed is:

1. A piston-cylinder assembly, comprising a cylinder housing; a piston coupled to a piston rod, the piston being arranged in the cylinder housing such that it is movable along a longitudinal axis; and a measuring device disposed in the cylinder housing and configured to measure the position of the piston, the measuring device including a PLCD sensor and a magnet.

2. The piston-cylinder assembly as claimed in claim 1, wherein the sensor extends substantially parallel to the longitudinal axis of the piston; and wherein at least one of the piston and the piston rod is movable axially relative to the sensor.

3. The piston-cylinder assembly as claimed in claim 1, further comprising a cylinder cover; and wherein the PLCD sensor is integrated into the cylinder cover.

4. The piston-cylinder assembly as claimed in claim 1, further comprising a trailer piston arranged substantially coaxially with respect to the longitudinal axis of the piston and movable axially relative to the piston and the piston rod.

5. The piston-cylinder assembly as claimed in claim 4, wherein the sensor extends at least partially within a recess in the trailer piston.

6. The piston-cylinder assembly as claimed in claim 4, wherein the magnet is arranged coaxially with respect to the longitudinal axis of the piston, and the PLCD sensor is arranged between the magnet and the trailer piston.

7. The piston-cylinder assembly as claimed in claim 1, wherein the piston and the piston rod are integrally connected.

8. A piston-cylinder assembly, comprising a cylinder housing; a piston coupled to a piston rod, the piston being arranged in the cylinder housing such that it is movable along a longitudinal axis; a measuring device disposed in the cylinder housing, the measuring device including a PLCD sensor arranged at least partially within a recess in the piston; and a magnet connected as a signal transmitter to the piston.

9. The piston-cylinder assembly as claimed in claim 8, wherein the magnet is a ring magnet and is arranged coaxially with respect to the longitudinal axis of the piston.

10. The piston-cylinder assembly as claimed in claim 9, wherein the PLCD sensor is integrated into the piston, and the ring magnet is integrated into one of the cylinder housing and a seal.

11. A piston-cylinder assembly, comprising a cylinder housing; a piston coupled to a piston rod, the piston being arranged in the cylinder housing such that it is movable along a longitudinal axis; a cylinder cover; and a measuring device disposed in the cylinder housing, the measuring device including a PLCD sensor disposed within a sensor housing formed integrally on the cylinder cover.

* * * * *